US010028583B2

(12) United States Patent
Erdel et al.

(10) Patent No.: US 10,028,583 B2
(45) Date of Patent: Jul. 24, 2018

(54) CLOSING DEVICE, EXTENSION RUNNER HAVING A CLOSING DEVICE AS WELL AS FURNITURE ITEM HAVING AN EXTENSION RUNNER

(71) Applicant: GRASS GMBH, Hoechst (AT)

(72) Inventors: Tobias Erdel, Sindelfingen (DE); Rolf Mintgen, Dornbirn (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 14/978,145

(22) Filed: Dec. 22, 2015

(65) Prior Publication Data

US 2016/0135595 A1 May 19, 2016

Related U.S. Application Data

(63) Continuation of application No. PCT/EP2014/063759, filed on Jun. 27, 2014.

(30) Foreign Application Priority Data

Jun. 28, 2013 (DE) ..... 20 2013 005 797 U

(51) Int. Cl.
*A47B 88/40* (2017.01)
*A47B 88/931* (2017.01)
(Continued)

(52) U.S. Cl.
CPC ..... *A47B 88/931* (2017.01); *A47B 88/467* (2017.01); *A47B 88/483* (2017.01); *A47B 88/57* (2017.01)

(58) Field of Classification Search
CPC . A47B 88/0085; A47B 8/047; A47B 88/0474; A47B 88/0477; A47B 88/0481;
(Continued)

(56) References Cited

U.S. PATENT DOCUMENTS 6,953,233 B2 * 10/2005 Lam ..... A47B 88/047 312/319.1
7,922,270 B2 * 4/2011 Weber ..... A47B 88/40 312/319.1
(Continued)

FOREIGN PATENT DOCUMENTS

AT 512 616 A1 9/2013
DE 9311238 U1 * 9/1993 ..... A47B 88/047
(Continued)

OTHER PUBLICATIONS

International Preliminary Report on Patentability (Application No. PCT/EP2014/063759) dated Dec. 29, 2015.
(Continued)

*Primary Examiner* — James O Hansen
(74) *Attorney, Agent, or Firm* — Burr & Brown, PLLC

(57) ABSTRACT

A closing device for closing a movably mounted drawer relative to a furniture carcass, including a catch piece releasably couplable with an entrainment mechanism of the drawer and mounted to be movable along a displacement portion, and an energy storage mechanism which is chargeable by a displacement movement of the catch piece. The catch piece includes a hold state at the end of and at the beginning of the displacement portion and the catch piece is locked in the hold state at the end of the displacement portion, holds the energy of the energy storage mechanism and allows the drawer to be decoupled. The catch piece is pivotable and carries out a pivoting movement along the displacement portion between the two holding states over a path of more than 20% of the displacement portion when the catch piece is displaced.

4 Claims, 5 Drawing Sheets

(51) Int. Cl.
*A47B 88/467* (2017.01)
*A47B 88/483* (2017.01)
*A47B 88/57* (2017.01)

(58) Field of Classification Search
CPC .... A47B 2210/0091; A47B 2210/0094; A47B 2210/0016; A47B 2210/0018; A47B 88/57; A47B 88/467; A47B 88/483; A47B 88/931
USPC ..... 312/330.1, 333, 334.1, 334.7, 334.44, 312/319.1
See application file for complete search history.

(56) References Cited

U.S. PATENT DOCUMENTS

2001/0008037 A1* 7/2001 Brustle ..... A47B 88/047 16/71
2004/0056573 A1* 3/2004 Chae ..... A47B 88/047 312/404
2006/0108901 A1 5/2006 Mao-Chin
2011/0129172 A1* 6/2011 Liang ..... A47B 88/0422 384/22
2013/0134852 A1* 5/2013 Salice ..... A47B 88/0481 312/319.1
2014/0346941 A1 11/2014 Gasser et al.

FOREIGN PATENT DOCUMENTS

DE 201 20 512 U1 4/2002
DE 20 2004 018 378 U1 2/2005
DE 20 2005 004 336 U1 6/2005
DE 20 2004 006 410 U1 9/2005
EP 1 430 810 A1 6/2004
JP 2007-308888 A1 11/2007
KR 20100105925 A * 10/2010 ..... A47B 88/00
KR 20100108795 A * 10/2010 ..... A47B 88/00
KR 20110003607 A * 1/2011 ..... E05F 5/003
KR 20120002183 A * 1/2012 ..... A47B 88/04
WO 2011/111921 A1 9/2011
WO WO 2013039269 A1 * 3/2013 ..... A47B 88/12

OTHER PUBLICATIONS

German Search Report (Application No. 20 2013 005 797.1) dated Jun. 27, 2014.
International Search Report and Written Opinion (Application No. PCT/EP2014/063759) dated Sep. 9, 2014.

* cited by examiner

CLOSING DEVICE, EXTENSION RUNNER HAVING A CLOSING DEVICE AS WELL AS FURNITURE ITEM HAVING AN EXTENSION RUNNER

CROSS REFERENCE TO RELATED APPLICATIONS

This application is a continuation of International Application No. PCT/EP2014/063759 filed Jun. 27, 2014, which designated the United States, and claims the benefit under 35 USC § 119(a)-(d) of German Application No. 20 2013 005 797.1 filed Jun. 28, 2013, the entireties of which are incorporated herein by reference.

FIELD OF THE INVENTION

The invention relates to a closing device, an extension runner having a closing device, and a furniture item having an extension runner.

BACKGROUND OF THE INVENTION

With reference to FIGS. 5-8 German Utility Patent No. 20 2004 006 410 U1 (the entire contents of which are incorporated herein by reference) discloses an automatic closing mechanism for drawer runners with a guide rail 12 which is to be fastened on a carcass wall CW of an item of furniture. The drawer D is arranged on a drawer rail 14 which is mounted so as to be displaceable relative to the guide rail 12. A movable catch component 24, which is prestressed in a bistable manner in two end positions which are spaced apart from one another in the direction of movement of the drawer by means of a spring arrangement with an elongated helical spring 40, is provided in a catch housing 22 on the guide rail or carcass rail 12. The catch component 24 has a receiving means 36 for an entrainment means 28 (FIG. 8) which is provided on the other rail 14. The entrainment means 28 moves into the receiving means 36 when approaching a closed position when there is a relative displacement of the rails and pivots the prestressed movable catch component 24, as a result of which the catch component 24 is unlocked from the associated end position. This results in the catch component 24 being moved into the other end position under the effect of the spring tension and the associated rail with drawer also being moved into the end position by means of the entrainment means 28 which is held in the receiving means, which provides the closed position of the drawer. A damping device 44, in which is movably arranged a damper element which communicates with the catch component 24 by means of transmission elements 36*a*, is provided in the catch housing 22.

When the drawer is opened, the catch component 24 is moved in the opening direction by means of the entrainment means 28 which is coupled into the catch component 24, as a result of which the helical spring 40 is tensioned until the catch component 24 is left in the end position locked by the entrainment means 28. The operation tensioning the spring calls for a not inconsiderable force to be applied by the user when opening the drawer.

SUMMARY OF THE INVENTION

The object underlying the present invention is to provide a closing device of the type designated in the introduction which comprises a characteristic that is improved with regard to the effort required for charging an energy storage means.

The present invention proceeds from a closing device for drawers for closing a movably mounted drawer into the closed end position relative to a furniture carcass, said closing device having a catch piece, which is releasably couplable with an entrainment means of the drawer and is mounted so as to be movable along a displacement portion, as well as having an energy storage means which is chargeable by means of a displacement movement of the catch piece, wherein the catch piece comprises a hold state at the end of and at the beginning of the displacement portion and wherein the catch piece is locked in the hold state at the end of the displacement portion, holds the energy of the energy storage means and allows the drawer to be decoupled. The core of the present invention now consists in that the catch piece is arranged so as to be pivotable and carries out a pivoting movement along the displacement portion between the two holding states over a path of more than 20% of the displacement portion when the catch piece is displaced. The pivoting movement of the catch piece is preferably effected along a guide track, a supporting point of the catch piece sliding along on the guide track. The pivoting movement is preferably further defined in such a manner that the supporting point, as a result of the pivoting movement of the catch piece, moves closer and closer to a line along which applied energy of the energy storage means on the catch piece runs. As a result, an ever increasing part of the energy of the energy storage means can be transmitted from the supporting point of the catch piece to the guide track, as a result of which the energy a user has to apply decreases. The user then simply has to apply the proportion of energy of the energy storage means which cannot be diverted to the guide track from the supporting point. In the end position, the supporting point of the catch piece on the guide track has arrived, for example, at a position of the guide track at which the guide track slopes so far with reference to the applied energy, and consequently the catch piece has pivoted so far, that the catch piece is automatically held in said position without any force being applied.

The guide track preferably slopes, when viewed in the opening direction of the drawer, from a horizontal alignment into an increasingly vertical alignment. A tangent at the end of the guide track is preferably vertical or almost vertical, where applicable even slopes slightly beyond the vertical such that to a certain extent the supporting point is able to engage behind the curve.

As a result of the pivoting movement of the catch piece, certainly the extension path is extended with a predefined spring tensioning path, however by means of the pivoting movement on a guide track the possibility is created for the effort expended by an operator on the drawer for charging the energy storage means, in particular a spring, albeit a self-extending spring, to remain the same where applicable, for example when arrived at the end of the guide track, even to decrease to the value of zero, at which the catch piece is then automatically held on the guide track and the entrainment means is preferably released from the catch piece in this position.

The pivoting movement is preferably effected over more than 30, 40, 50, 60, 80, 90% of the displacement path, where applicable from the beginning. The possibility of holding the energy for charging the energy storage means, in particular a spring, albeit the self-tensioning spring, substantially equal over the displacement portion is provided as a result. This is achieved in an increasing manner as the pivoting movement is realized along an ever increasing part of the displacement portion.

In a preferred development of the present invention, the pivoting movement is forcibly actuated over a guide track. As a result of the forcible actuation, which preferably extends in a sloping manner with respect to the displacement path of the catch piece, it is possible for the catch piece to be always supported unambiguously on the guide track and consequently to absorb the energy of the energy storage means. The energy of the energy storage means can act, for example, on a pivot axis of the catch piece. In the end position, the acting energy of the energy storage means, in particular the spring force of a tension spring, the pivot axis of the catch piece and the supporting point of the catch piece on the guide track are preferably arranged along a line, at the same time with the guide track preferably substantially vertically inclined. As a result, it is possible in this position for the catch piece to be held automatically in said position even if external forces are removed and thus to be able to be utilized as a holding state at the end of the displacement portion thereby holding the energy of the energy storing means.

In an advantageous development of the invention, the pivoting movement of the catch piece is predefined as a result of abutment against a curved element. The curved element preferably defines the guide track.

In a preferred development of the invention, the catch piece comprises an abutment element which is supported on the guide track. The abutment element is preferably supported on the curved element during a pivoting movement. As a result, by means of the abutment element the curved element is able to absorb forces which act on the catch piece such that said energy does not have to be provided by the user.

In order to be able to keep a constant connection to the entrainment means in the coupled state when the catch piece is pivoting, it is further proposed that the catch piece includes a receiving region for the entrainment means in which the entrainment means is able to be moved relative to the catch piece during a pivoting movement of the catch piece with the entrainment means not-uncoupled.

An advantageous simple development of the receiving region can be developed such that the receiving region has a slot-like recess. The entrainment means can be moved in said slot-like recess during a pivoting movement of the catch piece.

In an advantageous manner, the receiving region, in particular the slot-like recess for the entrainment means is matched in such a manner to the pivoting movement of the preferably forcibly actuated catch piece that when the catch piece is pivoted, the entrainment means is moved in the receiving region extensively without any additional expenditure of force. This is preferably a curved slot.

In a further preferred development of the invention, the receiving region is open on one side. The opening on one side makes it possible for the entrainment means to be able to be uncoupled from the catch piece, in particular in an end position with the energy storage means charged.

BRIEF DESCRIPTION OF THE DRAWINGS

Several exemplary embodiments of the invention are explained in more detail by way of the following figures whilst specifying further advantages and details, in which figures.

DETAILED DESCRIPTION OF THE INVENTION

Figure 1:
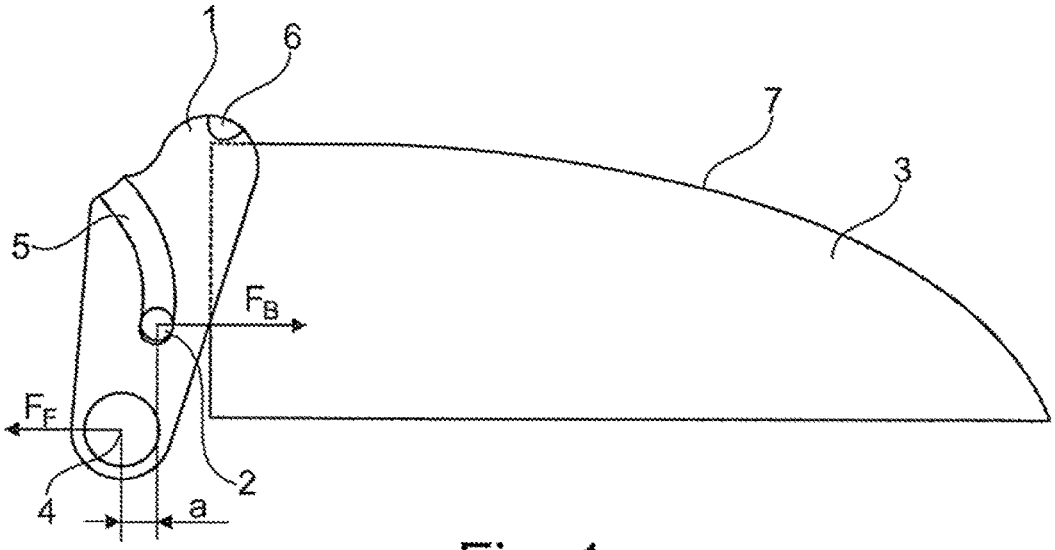
FIG. 1 shows a schematic side view of a curved element with a catch piece in a position in which a drawer is fully closed, that is to say at the beginning of a displacement portion of the catch piece.
Figure 2:
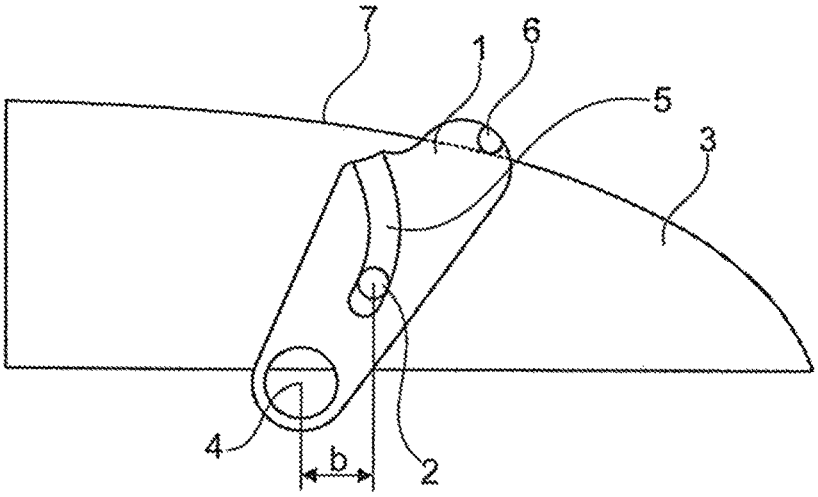
FIG. 2 shows the components from FIG. 1 with a position of the catch piece between the beginning of the displacement portion from FIG. 1 and a holding state at the end of the displacement portion.
Figure 3:
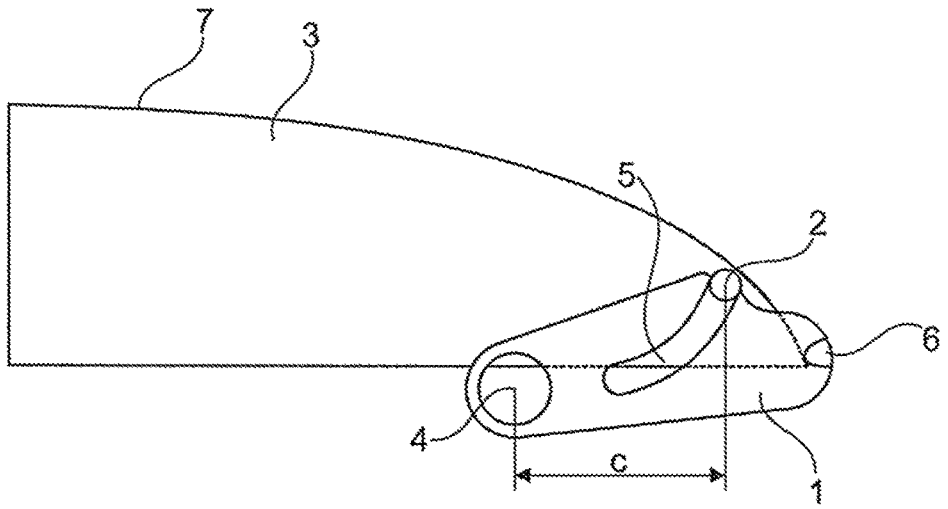
FIG. 3 shows a state of the components from FIG. 1 with a catch piece in a position in which an entrainment means is able to be uncoupled.

FIGS. 1 to 3 show the components catch piece entrainment means 2 and curved element 3 of a closing device with different positions of the catch piece 3 along a displacement path.

The catch piece 1 has a pivot axis 4, a curved slot 5 for receiving the entrainment means 2 as well as an abutment element 6. The abutment element 6 slides along a curved track 7 of the curved element 3 with the catch piece 1 being displaced along a displacement portion out of a start position according to FIG. 1 into an end position according to FIG. 3.

A user encounters the following conditions when the catch piece is displaced as a result of, for example, displacing a drawer (not shown) with regard to the force that he has to expend:

A force $F_B$ of a user acts on the entrainment means 2 by means of the drawer which is coupled with the entrainment means 2. On the other side, the energy of an energy storing means which pulls the drawer closed, for example, a spring force $F_F$ according to the force marked in FIG. 1, abuts against the pivot axis 4.

Normally, the opening force increases corresponding to the spring force according to Hooke's law $F_F=D\cdot s$, wherein D is the spring constant and s the opening path. A user must then apply an opening force $F_B$ which corresponds to the spring force $F_F$.

The curved element 3 with the abutment element 6 of the catch piece 1 which is moved along the same results, however, in other conditions for the user with regard to the opening force $F_B$.

In FIG. 1, the user starts with a force $F_B$ which corresponds substantially to the spring force $F_F$. In this case, the spacing between the entrainment means, on which the force $F_B$ acts, and the pivot axis comprises the value a.

Figure 4:
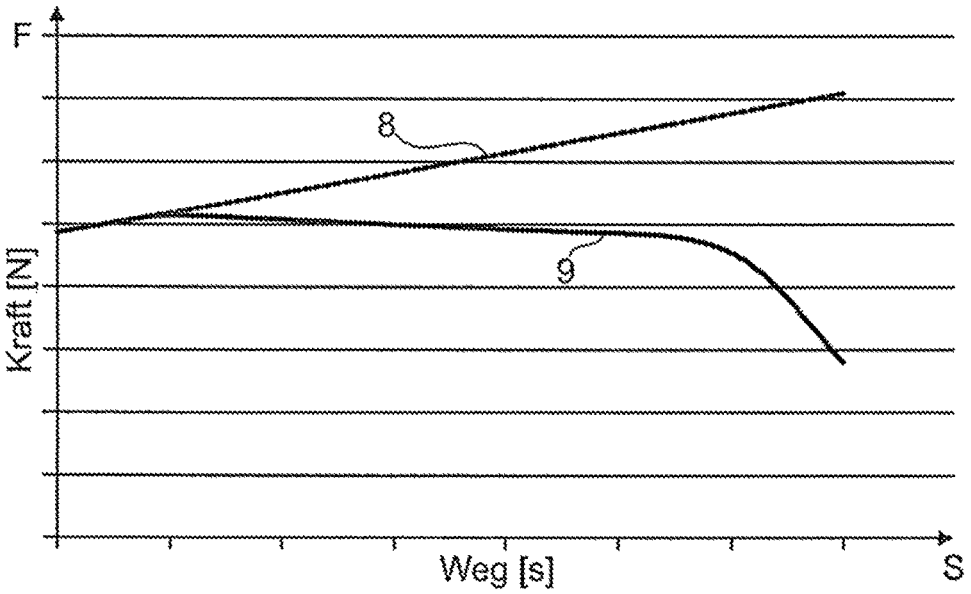
FIG. 4 shows a force-distance diagram of a conventional closing device and of a closing device according to the invention with a pivotable catch piece.
Figure 5:
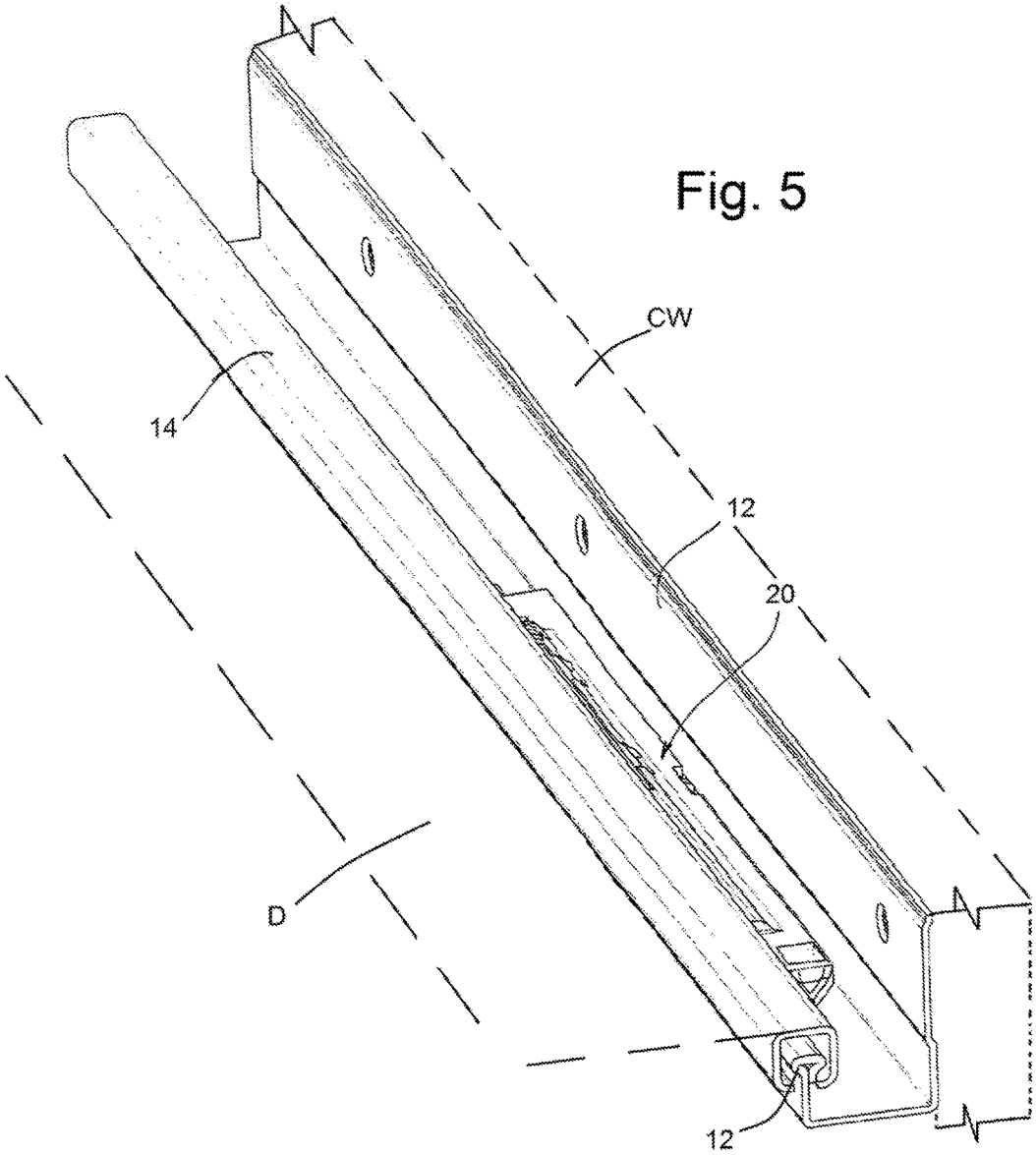
FIGS. 5-8 show the closing mechanism from DE 20 2004 006 410 U1.
Figure 6:
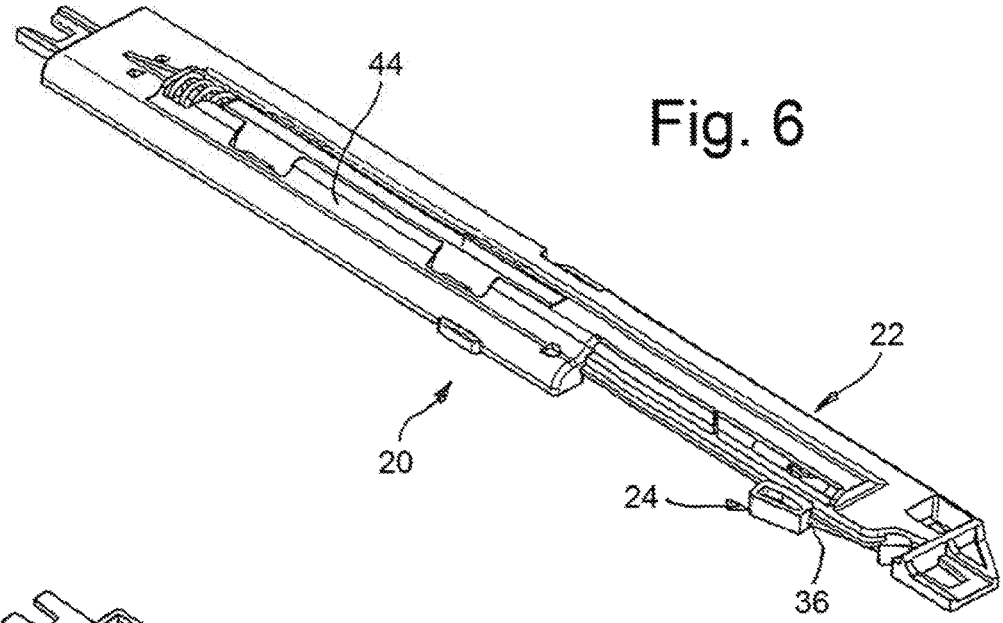
Figure 7:
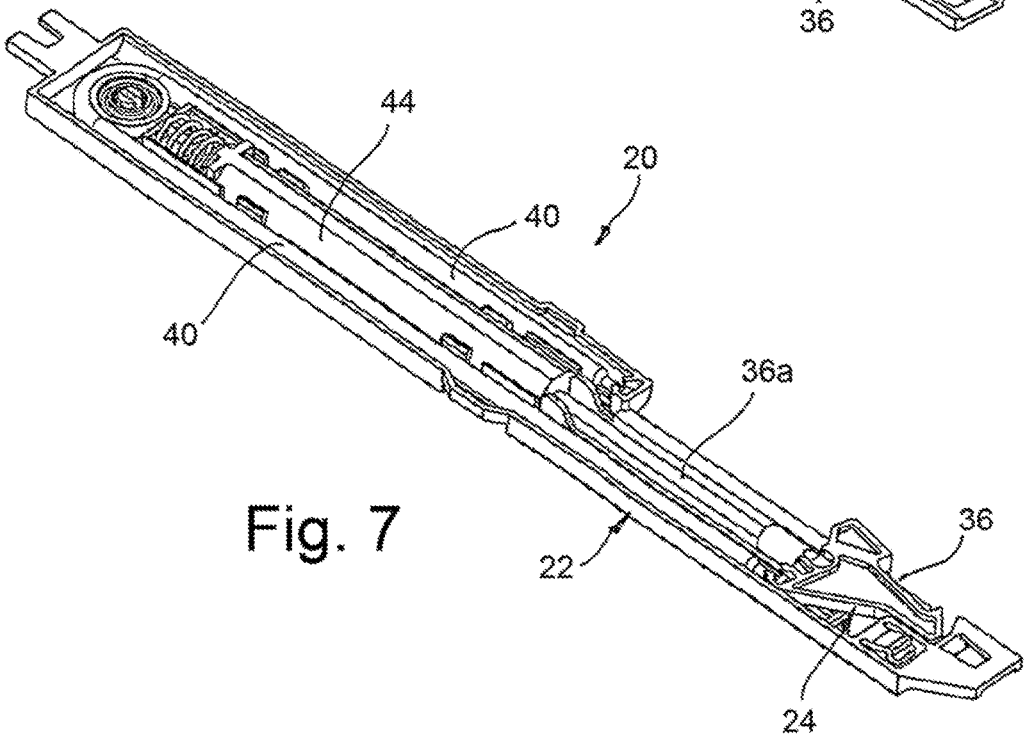
Figure 8:
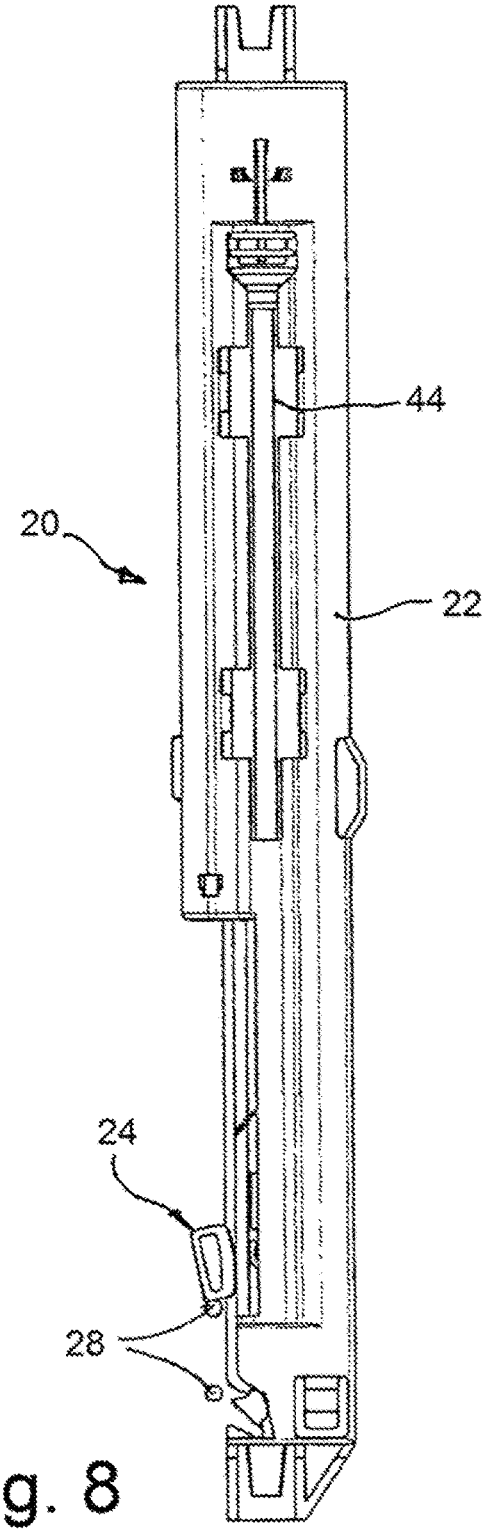

Along the path (on the right-hand side in FIGS. 2 and 3) the abutment element 6 slides on the curved track 7 which slopes downward, as a result of which the catch piece 1 is pivoted clockwise. The abutment element 6, in this case, remains fixedly in the abutment on the curved track 7 as a result of the force conditions which the entrainment means generates in the slot 5. The result of the sloping curved track is that a larger and larger proportion of the restoring forces of a spring (not shown) are able to be supported on the curved element 3 by means of the abutment element 6, as a result of which the force $F_B$ which is decisive to the user is not increased in a linear manner as expected, but as shown in the force-distance diagram according to FIG. 4 increases initially somewhat, then even falls slightly and at the end, when the curved track is more clearly sloping, where applicable up to the vertical, falls away severely, possibly to zero, which is not shown, however, in the force-distance diagram. A conventional closing device, as is disclosed, for example, in German Utility Patent No. 20 2004 006 410 U1, is shown as curve 8 in the force-distance diagram. Corresponding to Hooke's law, the curve is a substantially straight line. The force-distance diagram for the closing device according to the invention is represented by the curve 9 which certainly does show a linear force increase at the beginning, but then falls away slightly and finally reflects a sharply decreasing force progression.

The situation is symbolized by an end point in FIG. 3. The catch piece 1 has been pivoted so far that the entrainment means 2 is able to move out of the slot 5, which is open on one side, which results in the drawer, from this point in time, then being able to move freely further in the opening direction. The catch piece 1 has preferably arrived, as a result of the curved track, in a position such that the catch piece is held there itself, that is to say the forces of the spring $F_F$ do not succeed in allowing the catch piece to snap back along the curved track.

In the position of the release, the entrainment means 2 is at a spacing c from the pivot axis of the catch piece when viewed in the opening direction.

All in all, the path 5 of the entrainment means has been lengthened by a distance c-a by the pivoting movement up to the release position. Such lengthening of the path does not normally take place in the case of a conventional closing device. For, in this case, the catch piece is simply pivoted right at the end along a very short path portion of a displacement path of the catch piece in order to move the catch piece into a locked position, and to release an entrainment means. However, the longer displacement path as result of pivoting the catch piece 1 means that the force required by the user on the entrainment means 2 when opening is reduced. The opening movement for a drawer is then more pleasant for the user.

A closing device according to the invention can be used, for example, in an automatic closing mechanism which is described in German Utility Patent No. 20 2004 006 410 U1. Reference is hereby made explicitly to the features and details provided therein.

LIST OF REFERENCES

1 Catch piece
2 Entrainment means
3 Curved element
4 Pivot axis
5 Slot
6 Abutment element
7 Curved track
8 Curve
9 Curve
12 Guide rail
14 Drawer rail
20 Catch component
22 Catch housing
24 Catch component
26 Entrainment means
38 Receiving means
**36*a*** Transmission means
40 Helical spring
44 Damping device
CW Carcass wall
D Drawer

The invention claimed is:

1. A closing device for closing a movably mounted drawer into a closed end position relative to a furniture carcass, said closing device comprising: a curved element having an outer peripheral surface with a curved track defined thereon, the curved track including a beginning position proximate an upper portion thereof, and an ending position proximate a lower portion thereof; a catch piece, the catch piece having an outer surface, an abutment element, and a curved slot, the curved slot having a first end defining an opening in the outer surface of the catch piece, a second end defined within the catch piece at a position spaced away from the first end, and an arcuate portion defined between the first end and the second end, and being releasably couplable with an entrainment element of the drawer, the catch piece being mounted so as to be movable along the curved track; an energy storage mechanism which is chargeable by means of a movement of the catch piece along the curved track, wherein the catch piece comprises a hold state at the ending position of the curved track, and a hold state at the beginning position of the curved track, wherein the catch piece is arranged so as to be pivotable and to carry out a pivoting movement along the curved track between the hold states over a path of more than 20% of the curved track when the catch piece is displaced, wherein the pivoting movement is forcibly actuated by the curved track, wherein the pivoting movement is predetermined by the abutment element of the catch piece abutting against the curved track; and wherein the entrainment element is received in the second end of the curved slot when the catch piece is located at the beginning position, is configured to move past the arcuate position of the curved slot when the catch piece moves along the curved track, and is configured to reach the first position of the curved slot and exit through the opening in the surface of the catch piece when the catch piece reaches the ending position, thereby freeing the drawer to move.

2. The closing device as claimed in claim 1, wherein the abutment element is supported against the curved element during the pivoting movement.

3. An opening device having a closing device as claimed in claim 1.

4. A furniture item having an opening device as claimed in claim 3.

* * * * *